US007694366B2

(12) United States Patent
Koch et al.

(10) Patent No.: US 7,694,366 B2
(45) Date of Patent: Apr. 13, 2010

(54) OPERATING TABLE

(75) Inventors: Guido Koch, Karlsruhe (DE); Matthias Kobuβ, Gaggenau (DE); Heiko Kottmann, Rastatt (DE); Jan Donat Olszewski, Rastatt (DE)

(73) Assignee: Maquet GmbH & Co. KG, Rastatt (DE)

( * ) Notice: Subject to any disclaimer, the term of this patent is extended or adjusted under 35 U.S.C. 154(b) by 647 days.

(21) Appl. No.: 11/598,316

(22) Filed: Nov. 13, 2006

(65) Prior Publication Data

US 2007/0107125 A1 May 17, 2007

(30) Foreign Application Priority Data

Nov. 14, 2005 (DE) ..... 10 2005 054 222

(51) Int. Cl.

| | |
|---|---|
| ***A61G 7/005*** | (2006.01) |
| ***A61G 7/008*** | (2006.01) |
| ***A61G 7/015*** | (2006.01) |
| ***A61G 7/018*** | (2006.01) |

(52) U.S. Cl. ..... 5/608; 5/600; 5/607; 5/610; 5/613; 5/616

(58) Field of Classification Search ..... 5/600, 5/607–611, 11, 613, 616
See application file for complete search history.

(56) References Cited

U.S. PATENT DOCUMENTS

| | | | | |
|---|---|---|---|---|
| 566,521 A | | 8/1896 | Leger | |
| 1,740,906 A | * | 12/1929 | Rothauszky et al. | 5/608 |
| 2,416,410 A | | 2/1943 | Shampaine | |
| 2,763,320 A | | 9/1956 | Schram | |
| 2,764,459 A | | 9/1956 | McDonald | |
| 2,771,330 A | * | 11/1956 | Zaalberg | 5/601 |
| 2,775,496 A | | 12/1956 | Berggren | |
| 2,816,806 A | * | 12/1957 | Zaalberg | 5/601 |
| 2,995,762 A | | 8/1961 | Albinson | |
| 3,226,734 A | * | 1/1966 | Coventon | 5/607 |
| 3,238,539 A | * | 3/1966 | Koch | 5/607 |
| 3,302,218 A | * | 2/1967 | Stryker | 5/607 |

(Continued)

FOREIGN PATENT DOCUMENTS

| | | |
|---|---|---|
| DE | 264297 | 8/1912 |

(Continued)

OTHER PUBLICATIONS

European Search Report for Application No. EP 06 12 3444, dated Aug. 22, 2008.

(Continued)

*Primary Examiner*—Robert G Santos
(74) *Attorney, Agent, or Firm*—McCormick, Paulding & Huber LLP

(57) ABSTRACT

In an operating table comprising a table column (10) with a column foot (14) and with a column head (16) and also a patient bed (12) which is connectable to the column head (16) and which is pivotable in relation to the table column (10) about at least one axis parallel to the bed plane, the column head (16) has provided on it a guide track (42) which is curved continuously about an axis of curvature and on which a saddle coupleable to the bed (12) is mounted such that it can be adjusted along the guide track (42) by means of a saddle drive.

25 Claims, 14 Drawing Sheets

U.S. PATENT DOCUMENTS

| | | | | |
|---|---|---|---|---|
| 3,328,079 | A | 6/1967 | Byczkowski et al. | |
| 3,362,704 | A | 1/1968 | Pilz | |
| 3,379,877 | A * | 4/1968 | Makino et al. | 378/179 |
| 3,388,700 | A * | 6/1968 | Mountz | 601/5 |
| 3,868,103 | A * | 2/1975 | Pageot et al. | 5/614 |
| 4,101,120 | A | 7/1978 | Seshima | |
| 4,176,415 | A | 12/1979 | Dickerson et al. | |
| 4,244,358 | A * | 1/1981 | Pyers | 606/242 |
| 4,597,119 | A | 7/1986 | Padgett | |
| 4,640,482 | A | 2/1987 | Rogers | |
| 5,031,547 | A | 7/1991 | Hirose | |
| 5,083,331 | A | 1/1992 | Schnelle et al. | |
| 5,220,698 | A | 6/1993 | Hannant | |
| 5,277,427 | A | 1/1994 | Bryan et al. | |
| 5,279,011 | A | 1/1994 | Schnelle | |
| 5,477,570 | A | 12/1995 | Hannant et al. | |
| 5,544,376 | A | 8/1996 | Fromson | |
| 5,564,852 | A | 10/1996 | Maxwell et al. | |
| 5,611,638 | A | 3/1997 | Dorr et al. | |
| 5,615,431 | A * | 4/1997 | Vassilli | 5/610 |
| 5,621,932 | A | 4/1997 | Strachan | |
| 5,649,833 | A | 7/1997 | Pfeuffer et al. | |
| 5,651,150 | A | 7/1997 | Kanitzer et al. | |
| 5,659,909 | A | 8/1997 | Pfeuffer et al. | |
| 5,754,997 | A | 5/1998 | Lussi et al. | |
| 5,769,720 | A | 6/1998 | Aiken et al. | |
| 5,787,528 | A | 8/1998 | Antinori | |
| 5,790,996 | A * | 8/1998 | Narfstrom | 5/610 |
| 5,914,796 | A | 6/1999 | Selin | |
| 5,969,488 | A | 10/1999 | Fromson | |
| 6,008,598 | A | 12/1999 | Luff et al. | |
| 6,073,284 | A | 6/2000 | Borders | |
| 6,095,713 | A | 8/2000 | Doyle et al. | |
| 6,351,678 | B1 | 2/2002 | Borders | |
| 6,390,927 | B1 | 5/2002 | Cleveland, III | |
| 6,396,224 | B1 | 5/2002 | Luff et al. | |
| 6,484,334 | B1 | 11/2002 | Borders et al. | |
| 6,560,492 | B2 | 5/2003 | Borders | |
| 6,565,156 | B1 | 5/2003 | Yamashita et al. | |
| 6,609,260 | B2 * | 8/2003 | Hand et al. | 5/600 |
| 6,619,872 | B2 | 9/2003 | Crorey et al. | |
| 6,634,202 | B1 | 10/2003 | Oetiker | |
| 6,722,289 | B2 | 4/2004 | Kato | |
| 6,862,761 | B2 * | 3/2005 | Hand et al. | 5/600 |
| 6,971,131 | B2 | 12/2005 | Bannister | |
| 6,986,179 | B2 | 1/2006 | Varadharajulu | |
| 7,010,369 | B2 | 3/2006 | Borders et al. | |
| 7,068,143 | B2 | 6/2006 | Doering et al. | |
| 7,089,612 | B2 | 8/2006 | Rocher et al. | |
| 7,154,397 | B2 | 12/2006 | Zerhusen et al. | |
| 7,181,791 | B2 | 2/2007 | Clayton | |
| 7,210,201 | B2 | 5/2007 | Maekle et al. | |
| 7,235,942 | B2 | 6/2007 | Nagaoka et al. | |
| 7,321,811 | B1 | 1/2008 | Rawls-Meehan | |
| 7,346,944 | B2 | 3/2008 | Shaw | |
| 7,367,740 | B2 | 5/2008 | Lazic et al. | |
| 7,398,790 | B2 | 7/2008 | Glatz | |
| 7,526,823 | B2 * | 5/2009 | Koch | 5/600 |
| 7,634,826 | B2 * | 12/2009 | Koch | 5/600 |
| 2002/0111701 | A1 | 8/2002 | Borders | |
| 2002/0170115 | A1 | 11/2002 | Borders et al. | |
| 2003/0078144 | A1 | 4/2003 | Gehrke | |
| 2003/0195644 | A1 | 10/2003 | Borders et al. | |
| 2004/0006821 | A1 | 1/2004 | Hand et al. | |
| 2004/0074003 | A1 | 4/2004 | Bannister | |
| 2004/0172757 | A1 | 9/2004 | Somasundaram | |
| 2007/0101497 | A1 | 5/2007 | Revenus | |
| 2007/0101500 | A1 | 5/2007 | Fruh et al. | |
| 2007/0107123 | A1 | 5/2007 | Koch | |
| 2007/0107124 | A1 | 5/2007 | Koch | |
| 2007/0107125 | A1 | 5/2007 | Koch | |
| 2007/0107126 | A1 | 5/2007 | Koch | |
| 2007/0107129 | A1 | 5/2007 | Burstner | |
| 2007/0110448 | A1 | 5/2007 | Ruch | |
| 2007/0116512 | A1 | 5/2007 | Katzenstein | |
| 2007/0118989 | A1 | 5/2007 | Koch | |
| 2009/0119842 | A1 * | 5/2009 | Koch | 5/600 |

FOREIGN PATENT DOCUMENTS

| | | | |
|---|---|---|---|
| DE | 4229318 | C1 | 9/1993 |
| DE | 296 10 726 | U1 | 9/1996 |
| DE | 19732467 | A1 | 2/1999 |
| DE | 197 51 320 | A1 | 5/1999 |
| DE | 19919496 | A1 | 11/2000 |
| DE | 102 53 878 | A1 | 5/2004 |
| DE | 102 53 906 | A1 | 6/2004 |
| EP | 0 457 246 | A1 | 11/1991 |
| EP | 0625348 | A1 | 11/1994 |
| EP | 0832603 | A1 | 4/1998 |
| EP | 0 913 139 | | 5/1999 |
| FR | 2388546 | | 11/1978 |
| GB | 1 321 193 | | 6/1973 |
| GB | 2260075 | A | 4/1993 |
| GB | 2 277 870 | A | 11/1994 |
| WO | 99 28146 | A1 | 6/1999 |
| WO | 02 055001 | A1 | 7/2002 |
| WO | 03 086263 | A1 | 10/2003 |

OTHER PUBLICATIONS

European Search Report for Application No. EP 06 12 3719, dated Sep. 7, 2007.

European Search Report for Application No. EP 06 12 3721, dated Jun. 20, 2008.

European Search Report for Serial No. EP 06 12 3598 dated Feb. 8, 2007.

V. Vitsas, et al., Performance Analysis of the Advanced Infrared (AIr) CSMA/CA MAC Protocol for Wireless LANs, Kluwer Academic Publishers, Wireless Networks 9, pp. 495-507.

European Search Report for Serial No. EP 06 12 3443 dated Feb. 7, 2007.

European Search Report for Serial No. EP 06 12 3596 dated Sep. 7, 2007.

European Search Report for Serial No. EP 06 12 3592 dated Nov. 29, 2007.

European Search Report for Serial No. EP 06 12 3593 dated Dec. 4, 2007.

* cited by examiner

OPERATING TABLE

CROSS REFERENCE TO RELATED APPLICATIONS

Applicant hereby claims foreign priority benefits under U.S.C. § 119 from German Patent Application No. 10 2005 054 222.0 filed on Nov. 14, 2005, the contents of which are incorporated by reference herein.

FIELD OF THE INVENTION

The invention relates to an operating table comprising a table column with a column foot and with a column head and also a patient bed which is connectable to the column head and is pivotable in relation to the table column about at least one axis parallel to the bed plane.

BACKGROUND OF THE INVENTION

Operating tables of the abovementioned type are, as a rule, mounted on the column head pivotably both about an axis (axis of inclination) directed transversely to the longitudinal direction of the patient bed and about an axis (axis of tilt) directed parallel to the longitudinal direction of the patient bed.

The bed must be at a relatively great distance from its pivot axes, so that it can execute a sufficiently large pivoting movement in the tilt direction or inclination direction before it butts against the column head. If the pivot axes are arranged above the lift guide in order to achieve sufficient freedom for the pivoting movements in the tilt and inclination directions, a lowering of the operating table to a low level is greatly restricted. If, on the other hand, the pivot axes are arranged such that they pass through the lift guide, this results in severe restrictions of at least one pivoting movement. This arises from the situation where, with the pivoting of the bed about the first pivot axis mounted on the column head, the mounting of the second pivot axis is pivoted in accompaniment. This then collides quickly with the lift guide.

SUMMARY OF THE INVENTION

The object on which the invention is based is to specify an operating table of the type mentioned in the introduction, which allows greater latitude in the adjustment of the bed about its axis of inclination and/or axis of tilt and in the vertical direction.

To achieve this object, it is proposed, according to the invention, that, in an operating table of the type mentioned in the introduction, the column head have provided on it a guide track which is curved continuously about an axis of curvature and on which a saddle coupleable to the bed is mounted such that the said saddle can be adjusted along the guide track by means of a saddle drive. Preferably, in this case, the axis of curvature of the guide track lies within the table column, so that the guide track is curved convexly upwards.

Since the saddle coupled to the patient bed slides externally on the curved guide track, there is no need for the pivot axis to be mounted so as to pass through the column head. This gives rise, within the column head, to free space which is available for height adjustment and allows a greater lift of the height drive. In particular, this type of construction also makes it possible for the column head together with the patient bed to be lowered to a greater extent. Since, at least in the case of a convexly curved guide track, the saddle can be moved as far as the end of the respective guide track, the angle of inclination of the patient bed can also be made very large correspondingly to the curvature of the guide track, without the patient bed butting against the column head.

Preferably, the guide track is arranged on a head frame which is pivotable with respect to the table column by means of a pivoting drive about a pivot axis perpendicular to the axis of curvature of the guide track. The mounting of this pivot axis may be arranged at the front and/or at the rear, that is to say laterally in relation to the lift guide, so that the construction space for this pivoting movement does not restrict the lifting movement. The patient bed can thereby be pivoted in two directions.

Preferably, the saddle drive has at least one push and/or pull element which is flexible at least in one direction and which is guided displaceably along the guide track and is connected, on the one hand, to the saddle and, on the other hand, to an actuator. A saddle drive can thereby be provided which, on the one hand, can exert a high force and, on the other hand, occupies only a small amount of space. Preferably, the actuator is a linear drive, for example a pressure-medium-actuated cylinder. A particularly space-saving and yet functionally reliable design of the saddle drive can be achieved in that the push and/or pull element is a rigid-back chain which can bend in only one direction. Such a chain can be connected directly to the piston of the pressure-medium-actuated cylinder and forms as it were a rigid piston rod which is nevertheless bendable, that is to say deflectable, on one side. A linear drive can thereby be provided, the stroke of which corresponds approximately to its overall length and in which no additional space is required for the extension of the piston rod.

In the type of construction described above, in which the rigid-back chain is connected directly to the piston and therefore also runs into the cylinder when the piston is retracted into the latter, it is expedient if the piston is acted upon by pressure medium in the push-out direction only. So that the saddle can in this case be adjusted in both directions, it is expedient if the saddle drive comprises two push or pull elements which are connected in each case to an actuator and which are arranged and configured such that they operate reciprocally.

In an alternative embodiment of the saddle drive, the latter may comprise at least one saddle-side gear element which can be driven by means of a motor and which is in engagement with a gear element arranged on the head frame. Expediently, the saddle-side gear element is a worm which is in engagement with a toothed ring fastened to the head frame.

To pivot the head frame about its pivot axis, it is proposed that the pivoting drive comprise two pressure-medium-actuated pivoting cylinders which are arranged within the column and, on the one hand, are supported on the column head and, on the other hand, engage on the head frame on both sides of the pivot axis. In this way, the necessary force for pivoting the patient bed can be applied conveniently. In another possibility, the pivoting drive comprises at least one worm wheel connected fixed in terms of rotation to the head frame and arranged coaxially with respect to the pivot axis and a worm which can be driven by means of a motor and is in engagement with the worm wheel.

It is conceivable that the bed is coupled to the saddle such that the longitudinal direction of the bed runs parallel to the axis of curvature of the guide track. In this case, the axis of tilt is parallel to the axis of curvature of the guide track. In a preferred embodiment, the bed can be coupled to the saddle in such a way that the longitudinal direction of the bed is perpendicular to the axis of curvature of the guide track. In this case, the axis of curvature of the guide track is equal to the axis of inclination.

So that the bed can be connected releasably to the column head in a way known per se, it is proposed, according to the invention, that the bed be arranged on a connecting frame having coupling elements which are intended for engagement with countercoupling elements arranged on the saddle. Preferably, in this case, the bed is mounted on the connecting frame pivotably about a pivot axis directed transversely to its longitudinal direction, in which case pivoting may take place by means of a bed actuating drive. In a preferred embodiment, the bed actuating drive comprises at least one drive unit with at least one servomotor which is fastened to the connecting frame or to the bed portion connected to the latter and which is in engagement with an element to be driven, connected in each case to the other part (bed portion or connecting frame).

In the preferred embodiment in which the axis of curvature of the guide track is identical to the axis of inclination, the pivoting of the patient bed about its pivot axis affords a further advantage, in combination with the displacement of the saddle on the guide track. When the saddle is displaced from one end of the guide track towards to the other end of the guide track, the patient bed can always be kept in a horizontal position by the latter simultaneously being pivoted in the opposite direction. The final effect is a horizontal displacement of the patient bed with respect to the supporting column, without a specific guide or a specific drive being required for this purpose. Moreover, in this case, in the position of the saddle at the end of the guide track, an additional lowering of the patient bed with respect to the middle position of the saddle, that is to say the highest point of the guide track, also occurs, without a height adjustment of the column head being required for this purpose. When the saddle is displaced towards one end and the patient bed pivots in the same direction, the pivot angles are added up to form a very large achievable angle of inclination.

As a rule, the patient bed is subdivided into individual segments which are adjustable in relation to one another. High flexibility in the adjustment of the patient bed into different positions suitable for various interventions is obtained when the bed comprises at least two bed segments which are connected to one another in an articulated manner about a joint axis coaxial with respect to the bed pivot axis, the bed actuating drive being designed such that the two bed segments can be adjusted together or individually each separately or individually each separately. For this purpose, the servomotor of the bed actuating drive may be drive-connected in each case via a coupling to one of the bed segments. If both couplings are actuated, both bed segments are pivoted simultaneously, that is to say the patient bed is pivoted as a whole. If only one of the couplings is engaged, the bed is bent in the region of the bed pivot axis.

BRIEF DESCRIPTION OF THE DRAWINGS

Further features and advantages of the invention may be gathered from the following description which explains the invention by means of exemplary embodiments, in conjunction with the accompanying drawings in which.

DETAILED DESCRIPTION OF THE INVENTION

Figure 1:
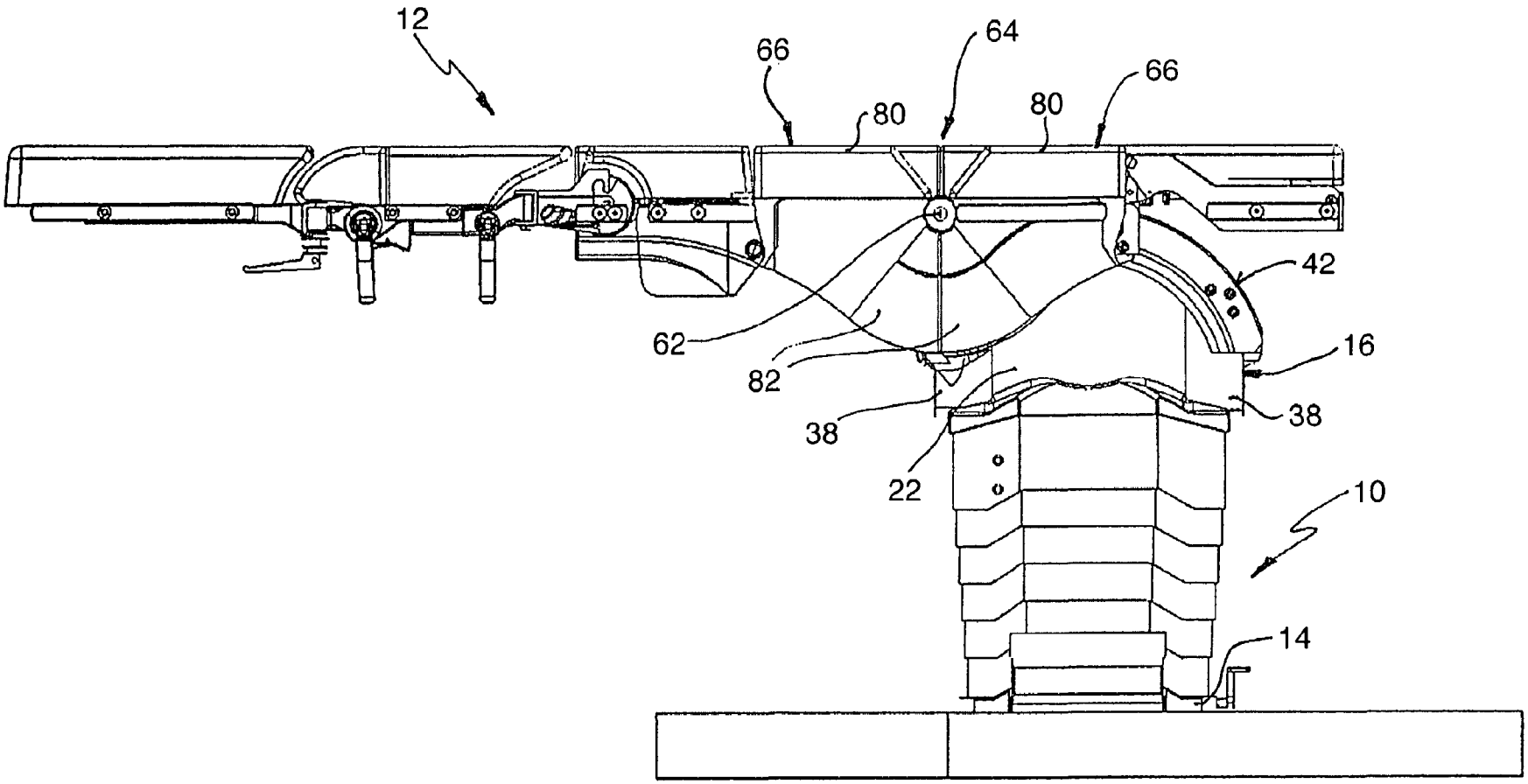
FIG. 1 shows a partially diagrammatic side view of an operating table according to the invention.

The operating table illustrated in FIG. 1 comprises an operating table column, designated in general by 10, and a patient bed 12 arranged on the latter. The table column or supporting column has a column foot 14 and a column head 16. Of the column portion lying between the column foot and column head, FIG. 1 shows only a cladding 18 which covers the carrying elements and height adjustment device and which comprises a multiplicity of ring-like elements which are displaceable telescopically in relation to one another during the height adjustment of the column, that is to say during the lowering and raising of the column head 16.

Figure 2:
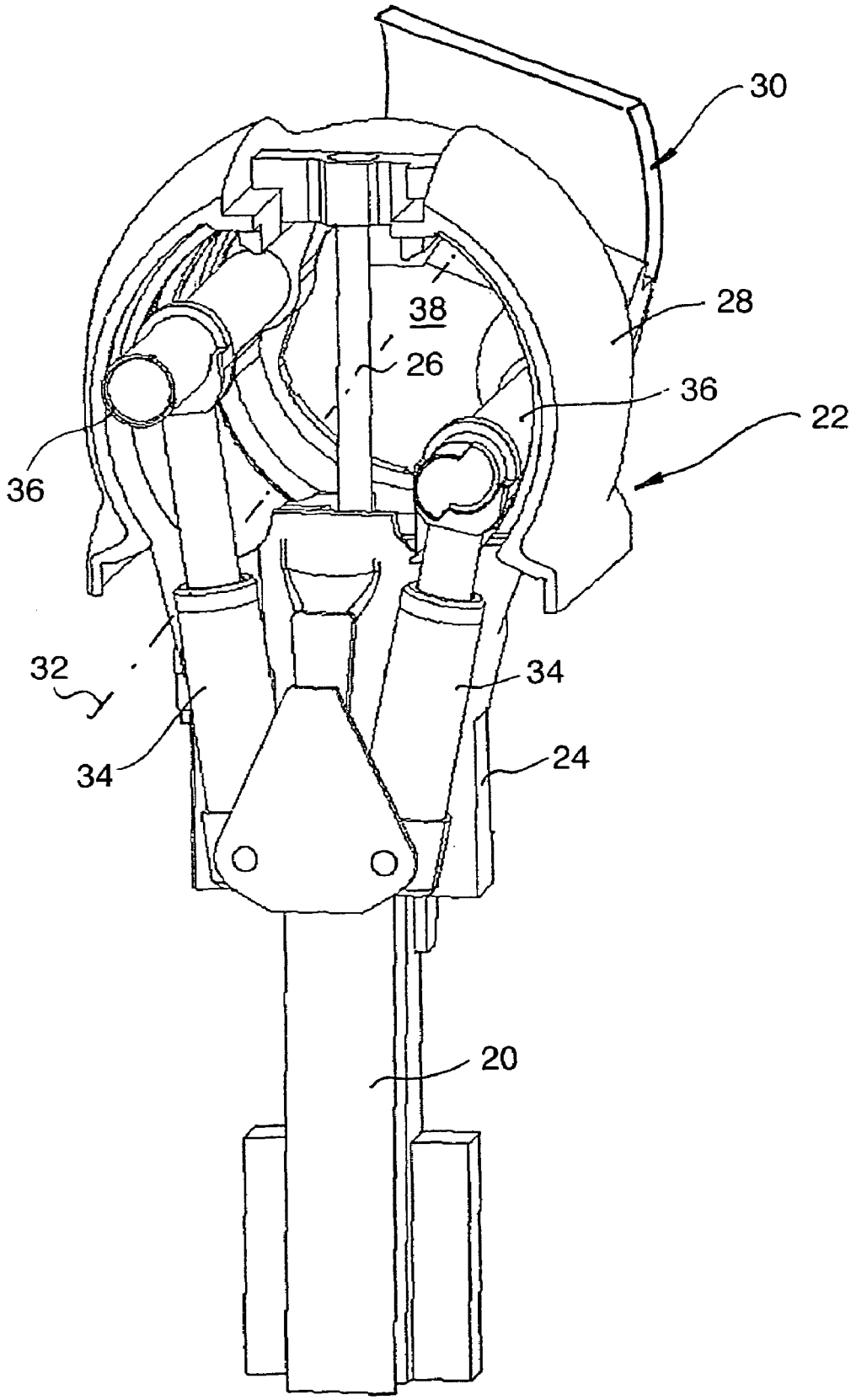
FIG. 2 shows a diagrammatic part-illustration of the column head and of the height adjustment device of the operating table column.

FIG. 2 shows part of the internal construction of the supporting column 10. A head part 22 is guided vertically displaceably on a vertical guide 20 by means of a guide portion 24. The displacement of the head part 22 takes place by means of a pressure-medium-actuated cylinder, of which FIG. 2 shows only the piston rod 26 which engages on the inner upper end of a bell-shaped bearing portion 28 of the head part 22. The vertical guide 20 may have a multi-part design in a way known per se, so that the guide portions can be pushed telescopically one into the other with the aid of a plurality of cylinders, in order to achieve a large stroke of the height adjustment device.

Figure 3:
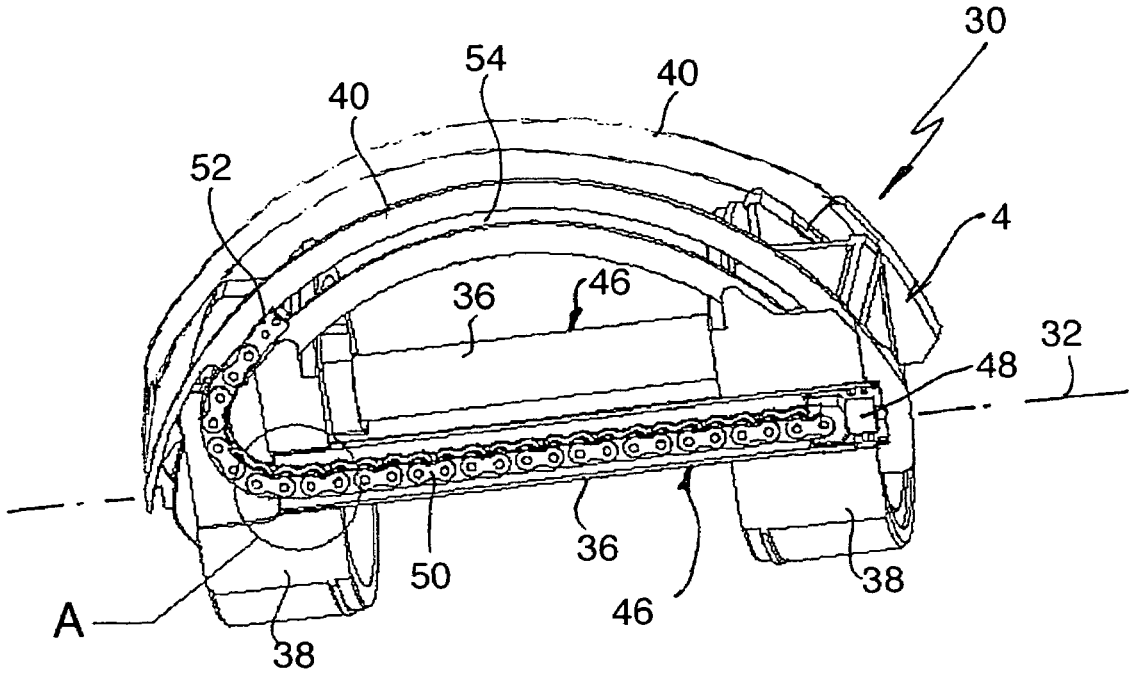
FIG. 3 shows a partially diagrammatic part side view of a head frame which is mounted pivotably on the column head and on which the guide track for the saddle is formed.
Figure 4:
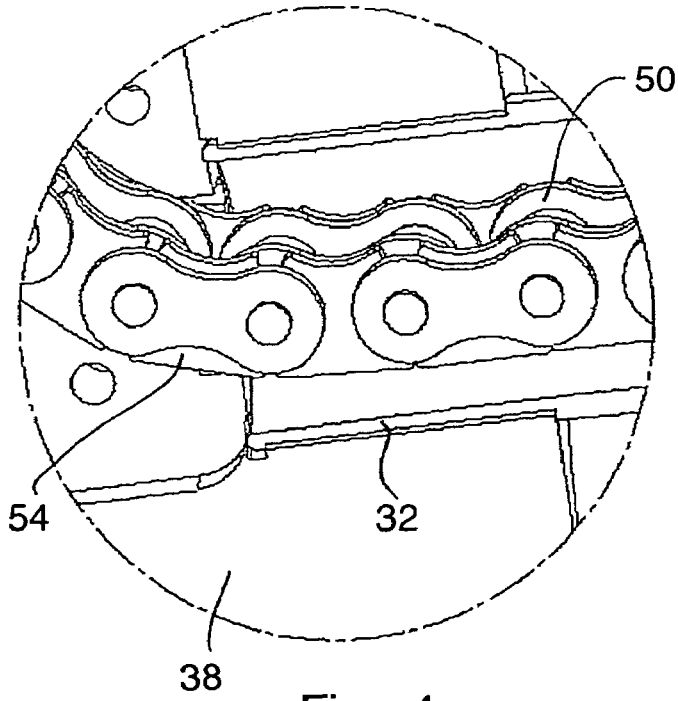
FIG. 4 shows an enlarged illustration of the detail, designated by A, from FIG. 3.

The head frame 30, illustrated only partially in FIG. 2 and in a side view in FIG. 3, is mounted in the bearing portion 28 pivotably about a pivot axis 32 (FIGS. 2 and 3). The pivoting movement of the head frame in the bearing portion 28 takes place with the aid of two working cylinders 34 which, on the one hand, are supported on the guide portion 24 of the head part 22 and, on the other hand, engage on cylindrical tubes 36 which connect the bearing portions 38 of the head frame to one another and the further function of which will be explained in more detail later on.

The head frame 30 comprises, furthermore, two yokes 40 curved in the form of an arc of a circle, which connect the two bearing portions 38 to one another and which form a convexly curved guide track 42 for a saddle 44, illustrated diagrammatically in FIG. 5 and FIGS. 9 to 15, to which the patient bed 12 can be coupled.

The saddle 44 is adjustable along the guide track 42 by means of a saddle drive. This saddle drive comprises two actuators in the form of pressure-medium-actuated piston/cylinder arrangements 46 comprising the cylindrical tubes 36 already mentioned above and in each case of a piston 48 displaceable in these. The piston 48 is connected directly to a rigid-back push chain 50 and can be acted upon by pressure fluid on its side facing away from the push chain. The rigid-back push chain 50 can bend in only one direction and is coupled at its end 52 facing away from the piston to the saddle 44. The push chain 50 is guided outside the cylindrical tubes 36 in each case in a guide slot 54 running within the bearing portion 38 or the yoke 40. The two actuators 46 with their push chains 50 are arranged opposite to one another and can be operated reciprocally, so that each actuator 46 moves the saddle 44 positively only when the chain is pushed out of the cylindrical tube 36. The pistons 48 of the actuators 46 are therefore acted upon by pressure medium in only one direction. As a result, on the one hand, sealing-off of the cylindrical tubes 36 at the outlet of the push chains is dispensed with. On the other hand, the hydraulic control is simplified, since, in the reciprocal operation of the actuators, only ever as much pressure medium flows out of one cylinder as flows into the other.

Figure 5:
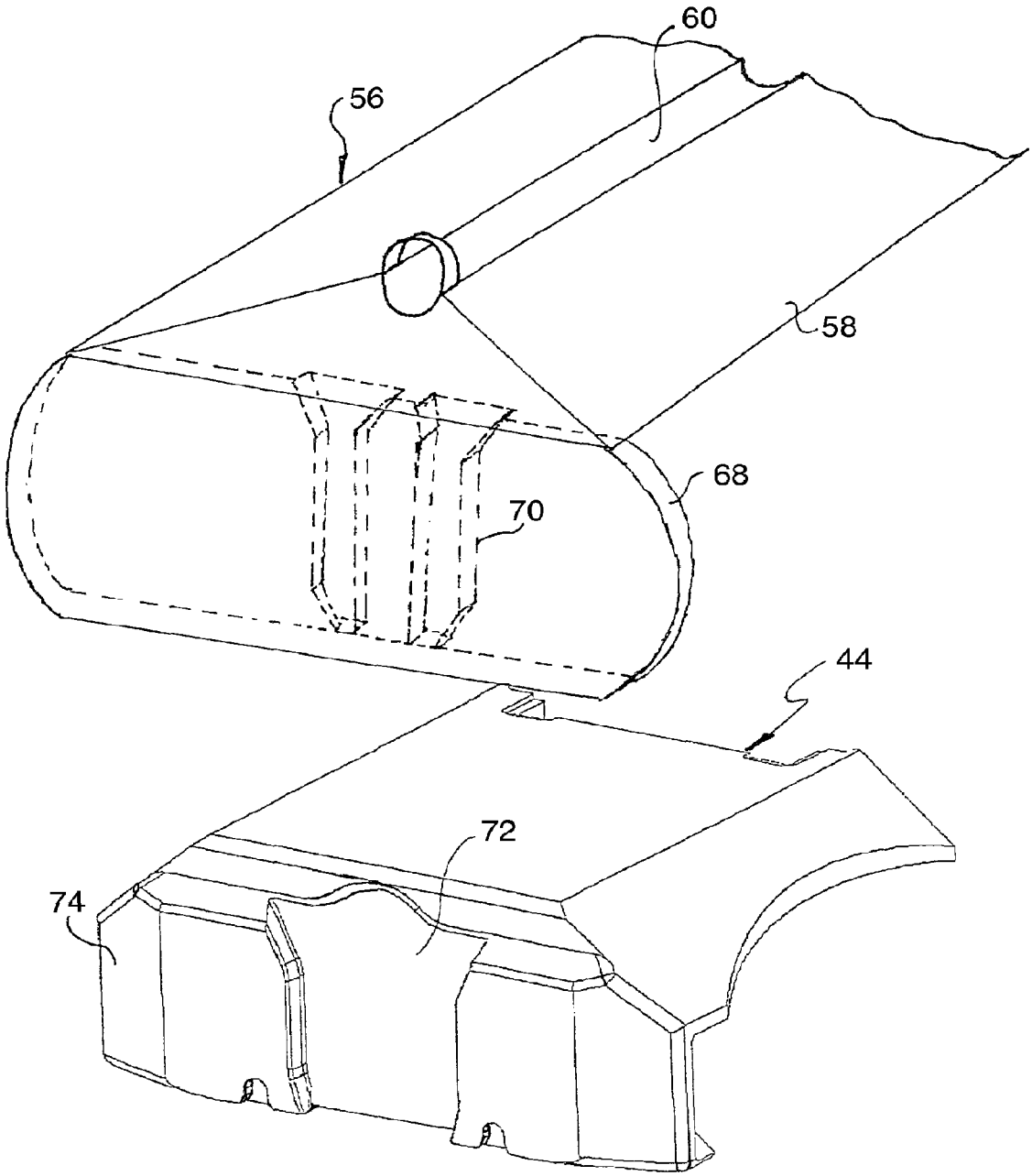
FIG. 5 shows a diagrammatic part-illustration of a connecting frame connected to a bed and of a saddle to which the connecting frame can be coupled.

The bed 12 may be connected directly to the saddle 44. In a preferred version, the bed 12 can be coupled to the saddle 44 via a connecting frame 56 (FIG. 5).

In one version, a segment of the bed may be connected directly to the saddle 44 or to the connecting frame 56. In this case, the inclination of the bed 12 is determined solely by the movement of the saddle on the guide track 42. When the saddle is at its highest point on the guide track 42, the bed 12 assumes a horizontal position, as shown in the diagrammatic illustration of FIG. 9. When the saddle 44 moves out of this position towards one of the ends of the guide track 42, the bed 12 is inclined correspondingly.

Preferably, the saddle 44 or the connecting frame 56 carries a bearing 60 in which at least one bed segment is mounted rotatably. Preferably, two bed segments 66 are arranged on both sides of the bearing 60, and the left-hand and right-hand side spars 78 of the bed segments 66 may be connected to one another by means of a shaft 62 and a coaxial hollow shaft. The segments 66 can be pivoted dependently on one another and/or independently of one another, as is explained later.

It should, in the first place, be stressed only that the entire bed 12 is pivotable about the axis of the shaft 62 in relation to the connecting frame 56 and therefore also in relation to the saddle 44.

The connecting frame 56 has, furthermore, two side cheeks 68 which project downwards from its middle plate 58 and only one of which is illustrated in FIG. 5. On the inside of each side cheek 68 is located a coupling element 70, illustrated by dashes in FIG. 5, which is intended for engagement into a reception pocket 72 formed on the outside of a side part 74 of the saddle 44, as can be seen in FIG. 5. The connection frame 56 and consequently the bed 12 can thereby be coupled releasably to the saddle 44, although the exact type of coupling will not be dealt with in any more detail here. Each side cheek 68 of the connecting frame 56 carries on the outside a drive device, illustrated in FIG. 6 and designated in general by 76, which serves for adjusting the segments 66 of the middle portion 64 of the bed 12 and which will be explained in more detail below with reference to FIGS. 6 to 8.

Figure 6:
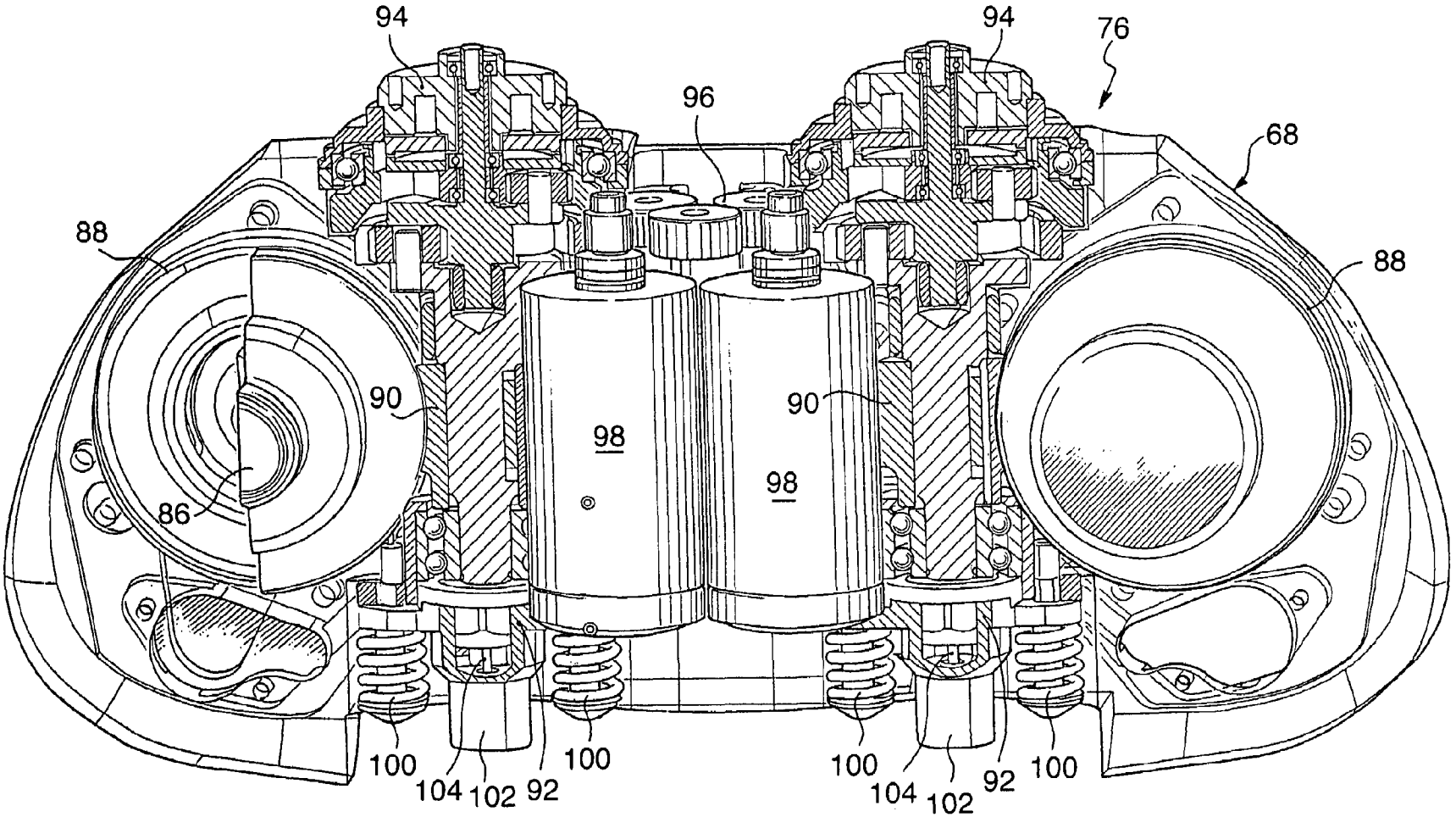
FIG. 6 shows a partially diagrammatic and partially sectional illustration of the bed actuating drive for pivoting the bed in relation to the connecting frame.
Figure 7:
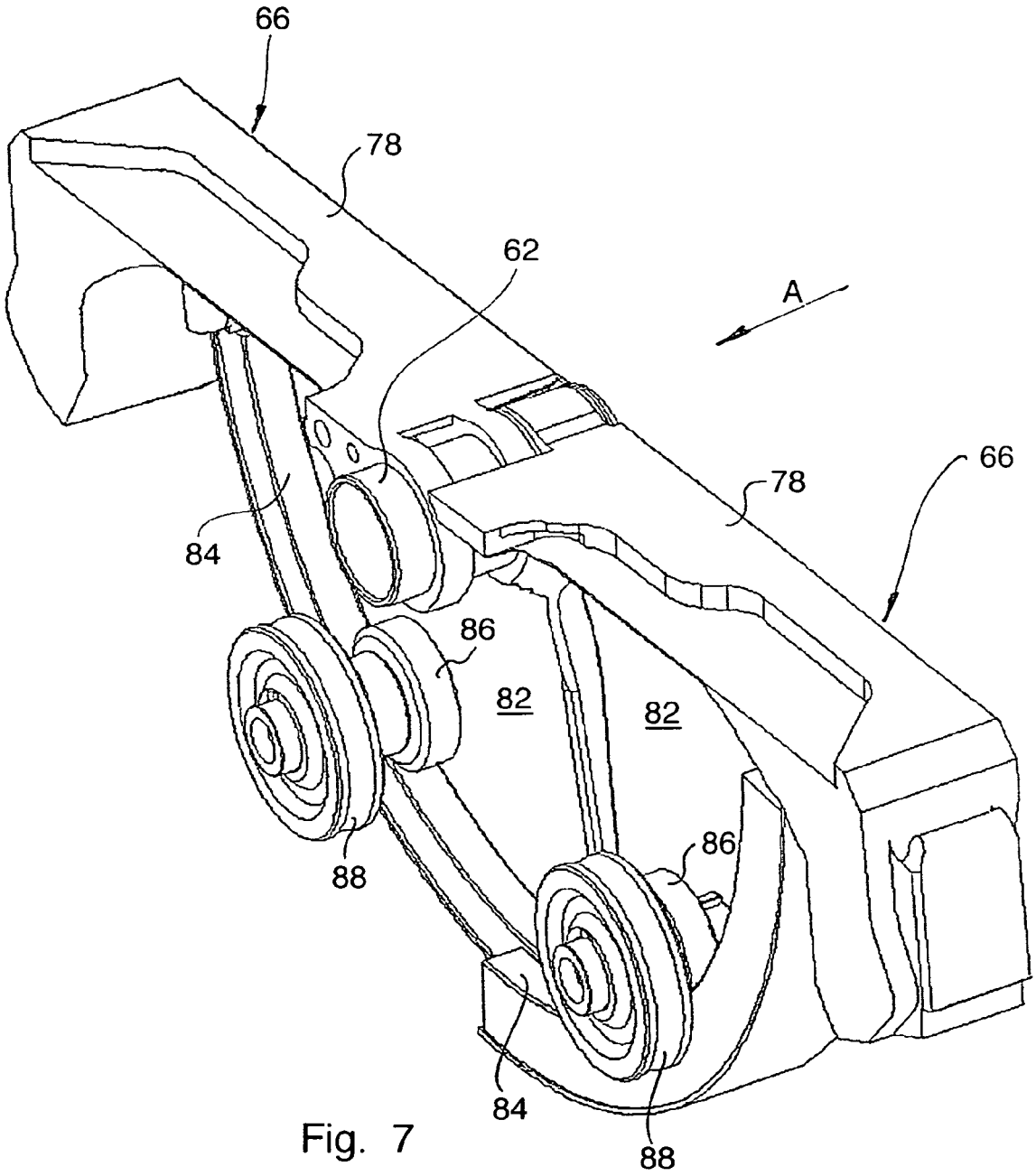
FIG. 7 shows a partially diagrammatic perspective illustration of two drive elements which are connected to two bed segments pivotable in relation to one another and which are in engagement with drive wheels of the bed actuating drive illustrated in FIG. 6.
Figure 8:
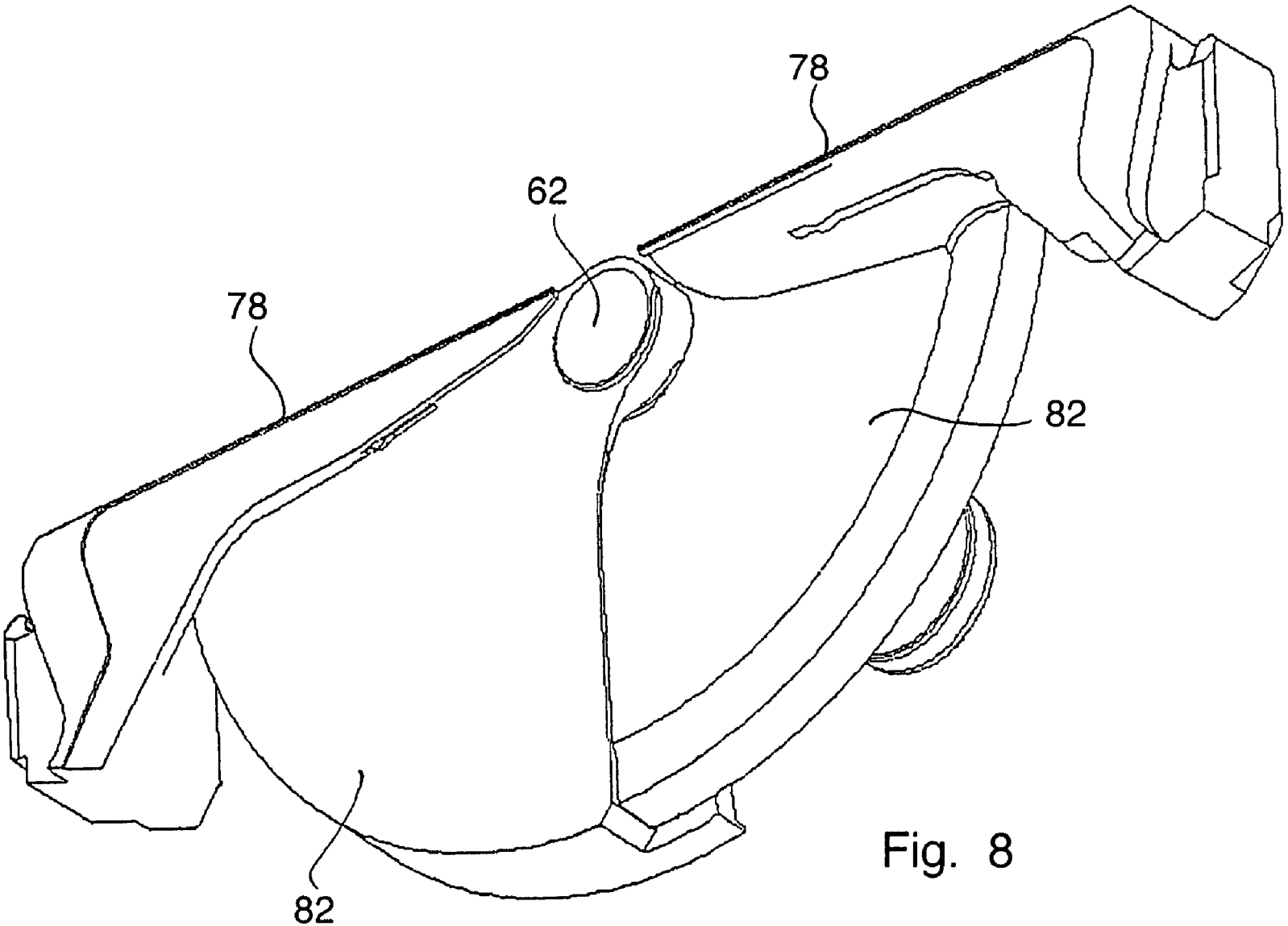
FIG. 8 shows a perspective view of the parts illustrated in FIG. 7, in the direction of the arrow A in FIG. 7.
Figure 9:
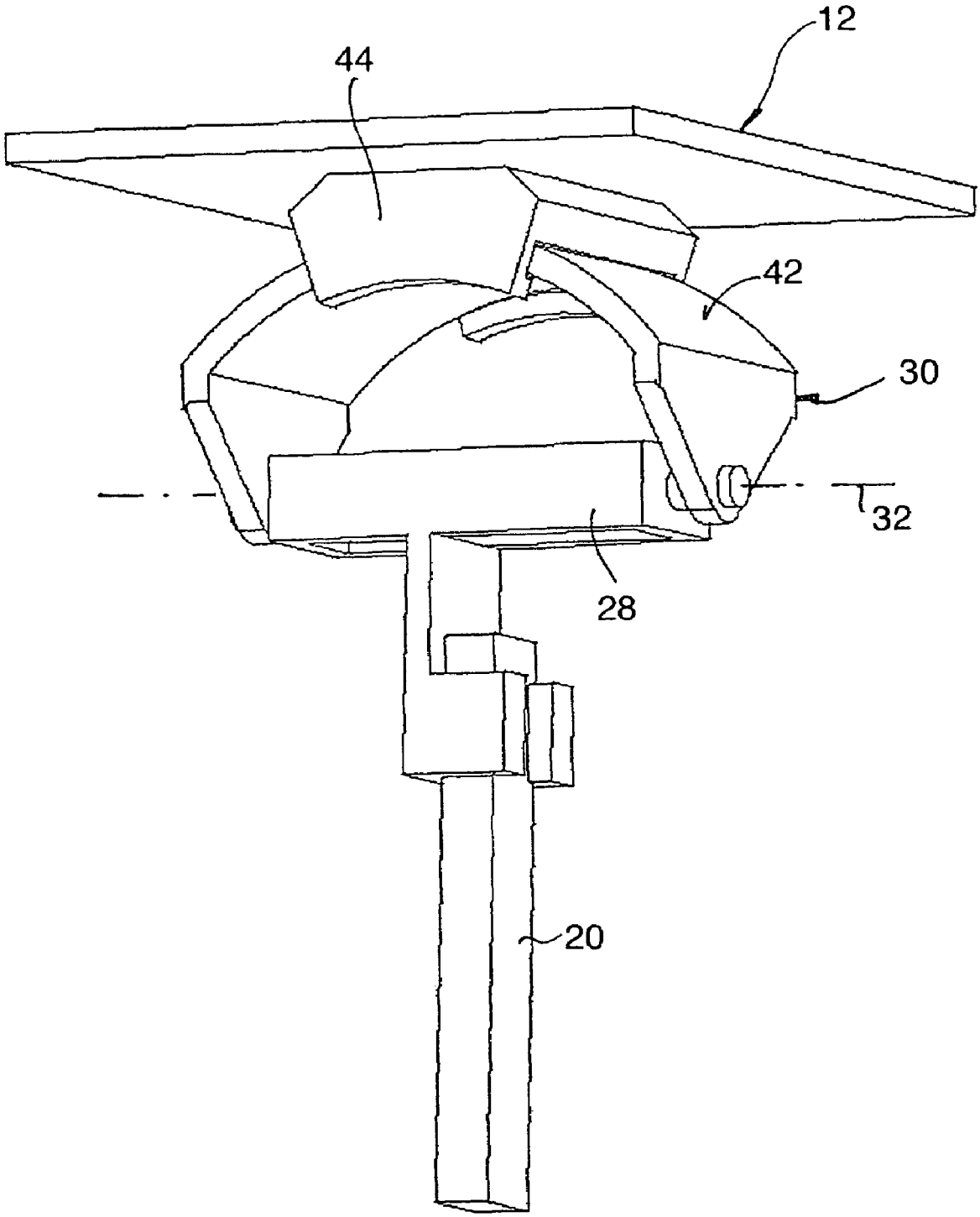
FIG. 9 shows a diagrammatic illustration of the column head with the head frame, with the saddle guided on the head frame and with a bed coupled to the saddle, according to a first embodiment of the invention.

FIGS. 7 and 8 show in each case a side spar 78 of a segment 66, a segment 66 comprising two such side spars on which upholstery 80 (FIG. 1) can be arranged. Each side spar 78 is connected on its underside to a sector disc 82 which at its lower edge curved in the form of an arc of a circle carries a toothed ring portion 84 with internal toothing. In this case, according to the illustration in FIGS. 7 and 8, the arrangement is such that the lower edge of one sector disc surrounds the lower edge of the other sector disc, so that the toothed ring portions 84 of the two sector discs lie next to one another in the axial direction of the shaft 62. The toothed ring portions 84 are in each case intended for engagement with a drive gearwheel 86 which is part of the drive device 76 illustrated in FIG. 6.

Figure 13:
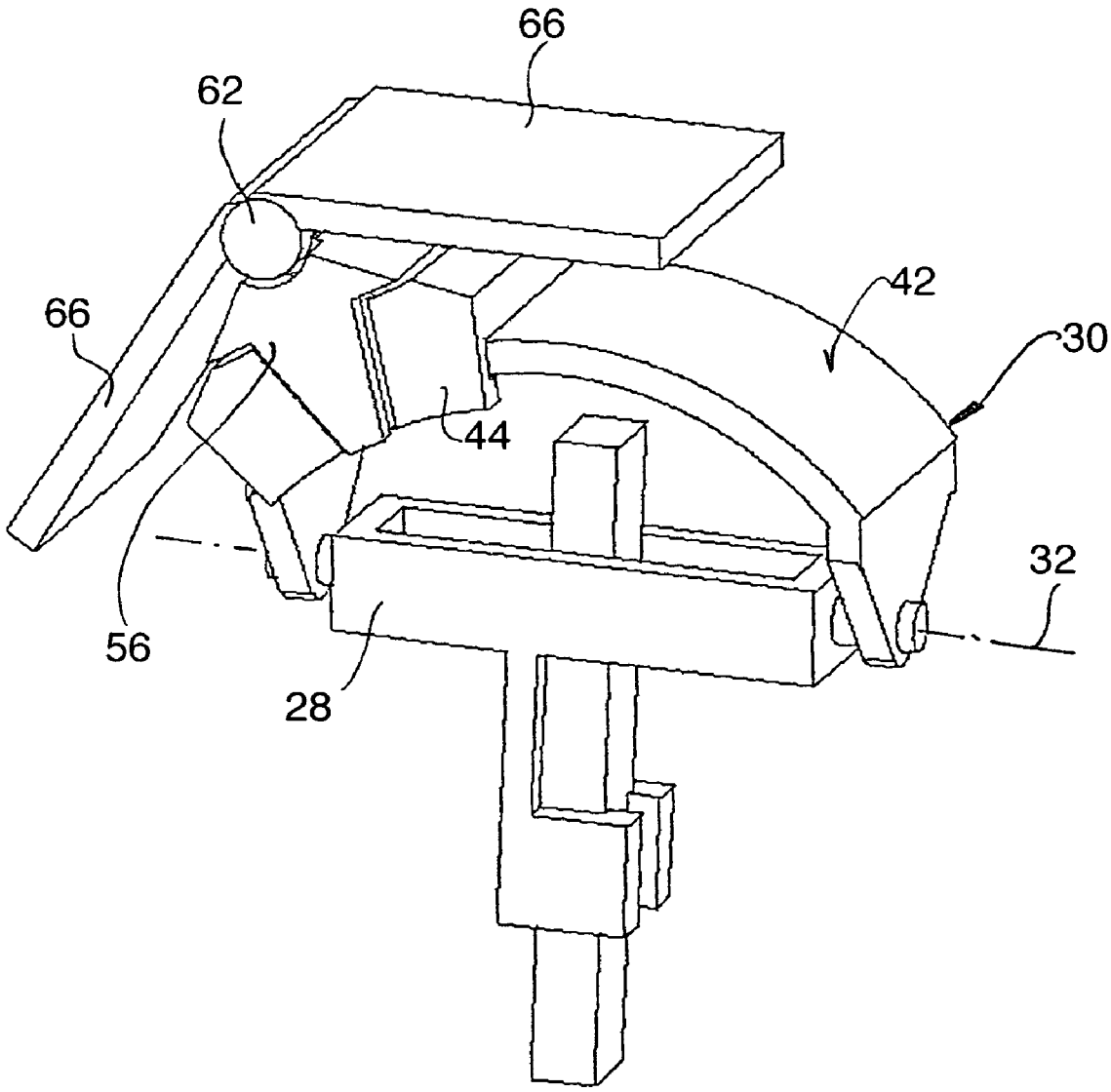

The drive gearwheels 86 are mounted rotatably on the side cheek 68 of the connecting frame 56 and are in each case connected fixedly in terms of rotation to a worm wheel 88. Each worm wheel 88 is driven via a gear worm 90 which is mounted rotatably in a bearing 92 on the side cheek 68 and which is drive-connected to two electric motors 98 via a shiftable coupling 94 and a gear 96. In some of the two motors 98, a single motor could also be provided in order to drive the worm wheels 90. The gear 96 has the effect that both motors 98 are always drive-connected to the two couplings 94. When both couplings 94 are engaged, both drive gearwheels 86 are driven in the same direction. As a result, the entire middle portion 64 is pivoted in the manner of a rigid plate about the axis of the shaft 62. If, by contrast, only one of the couplings 94 is engaged, then also only one of the segments 66 is adjusted, so that the segments 66 form an angle with one another (FIG. 13).

The bearing 92 of the worm wheels 90 is displaceable axially counter to the prestressing force of springs 100 (FIG. 6). Furthermore, the bearing 92 is assigned a limit switch 102 which can be actuated via a tappet 104 as a result of an axial displacement of the bearing 92. If, during a downward pivoting of one of the segments 66, the latter or a plate portion, connected to it, of the bed 12 were to butt against an obstacle, so that further movement is blocked, the reaction force causes an axial displacement of the gear worm 90 or of its bearing 92, with the result that the tappet 104 of the limit switch 102 is actuated. The electric motors 98 can be switched off via the actuation of the limit switch, so that damage to the operating table or to the drive device 76 or risk to the patient and to the operating personnel can be avoided.

The various possibilities for adjusting the patient bed 12 on the supporting column 10 will be explained in more detail with reference to FIGS. 10 to 15, in the embodiment according to FIGS. 10 to 15 the bed 12 being connected to the saddle 44 via the connecting frame 56. In so far as only the movement of the saddle 44 and of the head frame 30 is described, however, the corresponding statements also apply, of course, to the embodiment according to FIG. 9 in which the bed 12 is connected directly to the saddle 44.

Figure 10:
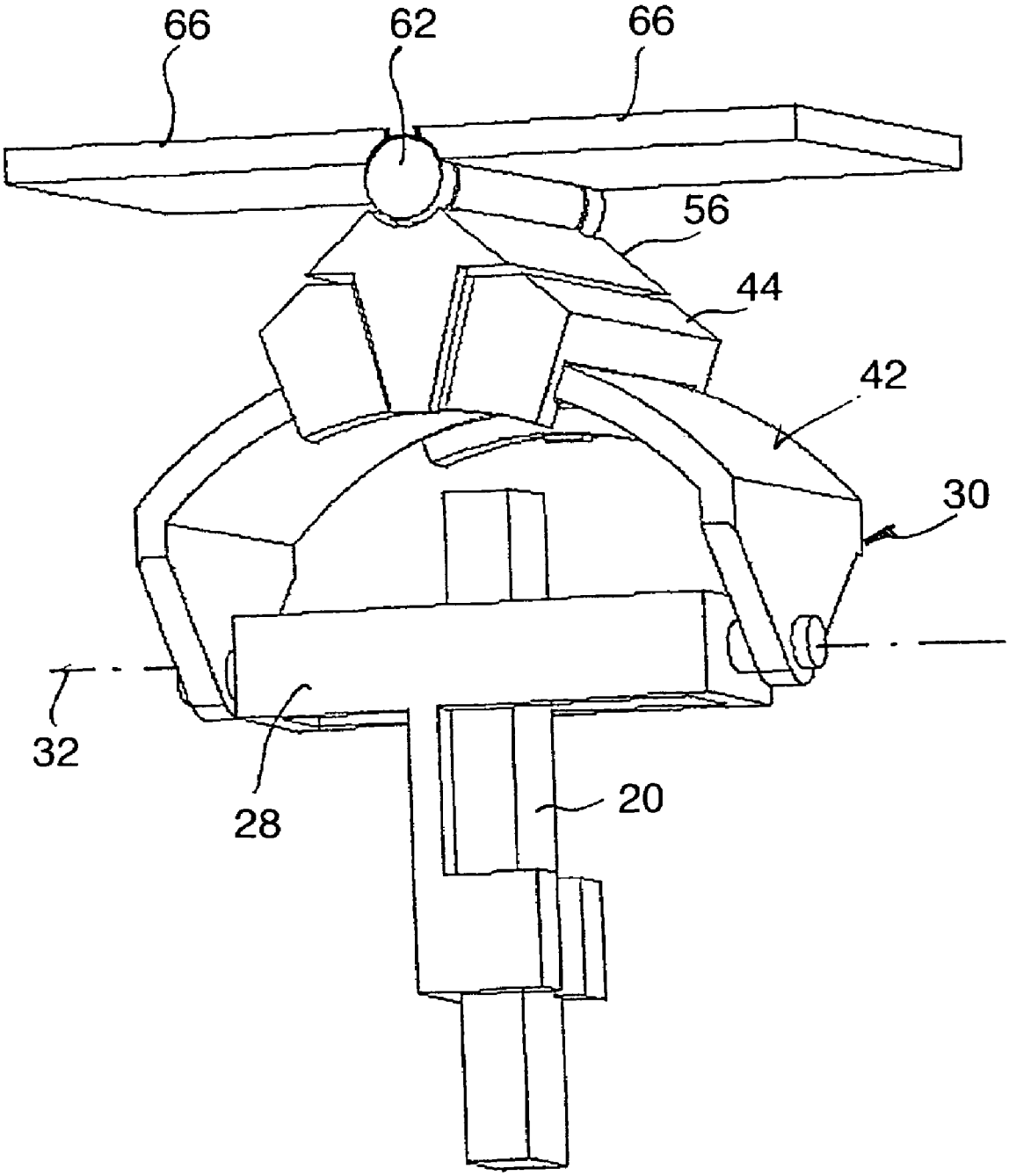
FIG. 10 to 15 show illustrations, corresponding to FIG. 9, of a second embodiment of the invention in various positions of the saddle and of the head frame.

FIG. 10 shows the saddle at the highest point of the guide track 42, that is to say in the middle between the ends of the latter. The bed 12 is set horizontally in relation to the connecting frame 56.

Figure 11:
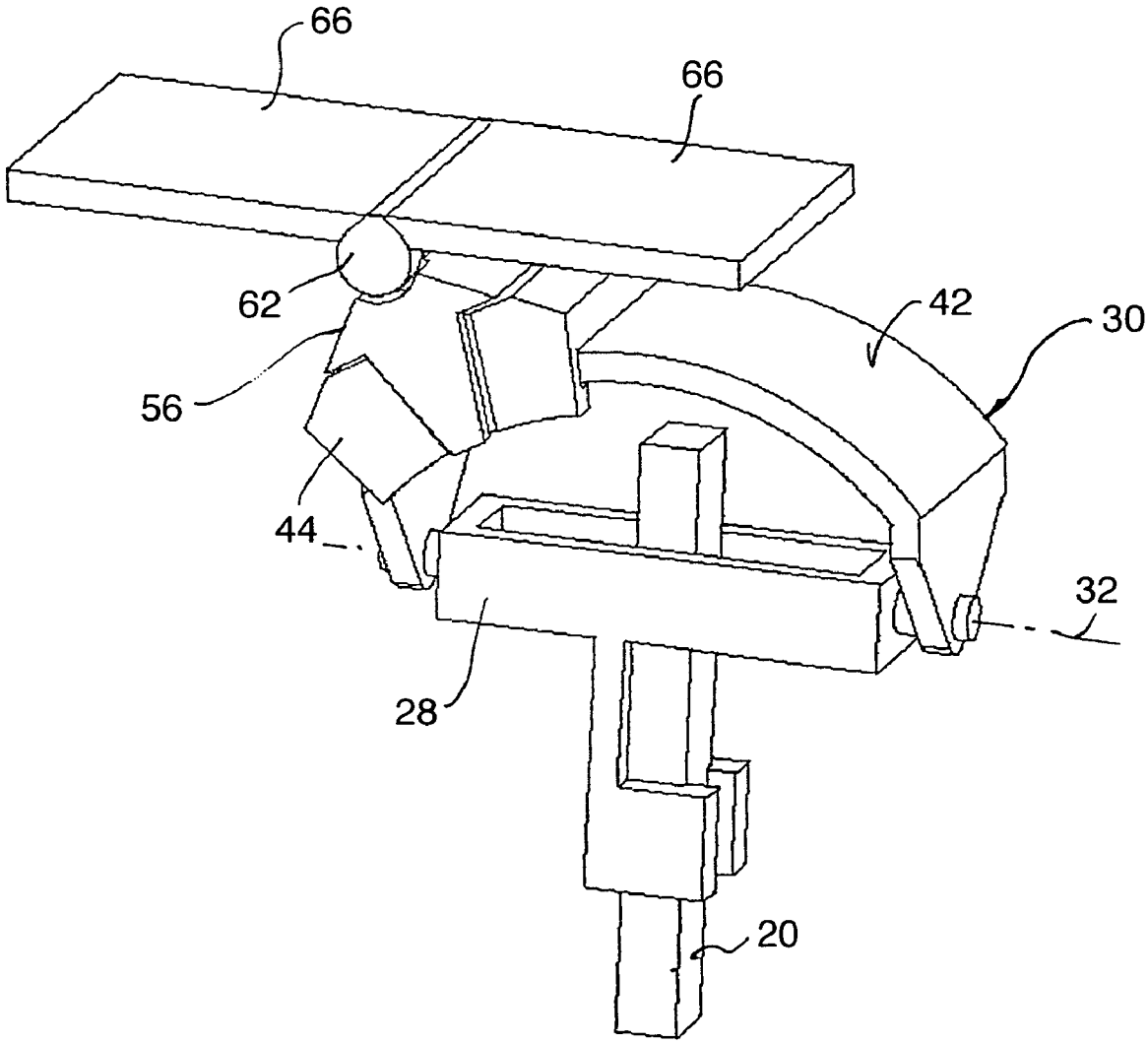

FIG. 11 shows a displacement of the saddle 44 towards one of the ends of the guide track 42. The bed 12 is simultaneously adjusted with respect to the connecting frame 56 such that it again assumes a horizontal position. It can be seen that the final effect of this is to correspond to a longitudinal displacement of the bed 12 and a lowering of the bed 12, as compared with the position in FIG. 10, without the head frame 30 or the entire column head having been adjusted vertically. By the saddle 44 being displaced from one end of the guide track 42 towards its other end, while the bed 12 is simultaneously pivoted with respect to the connecting frame 56, a horizontal displacement of the bed 12 can thus be achieved as a result.

Figure 12:
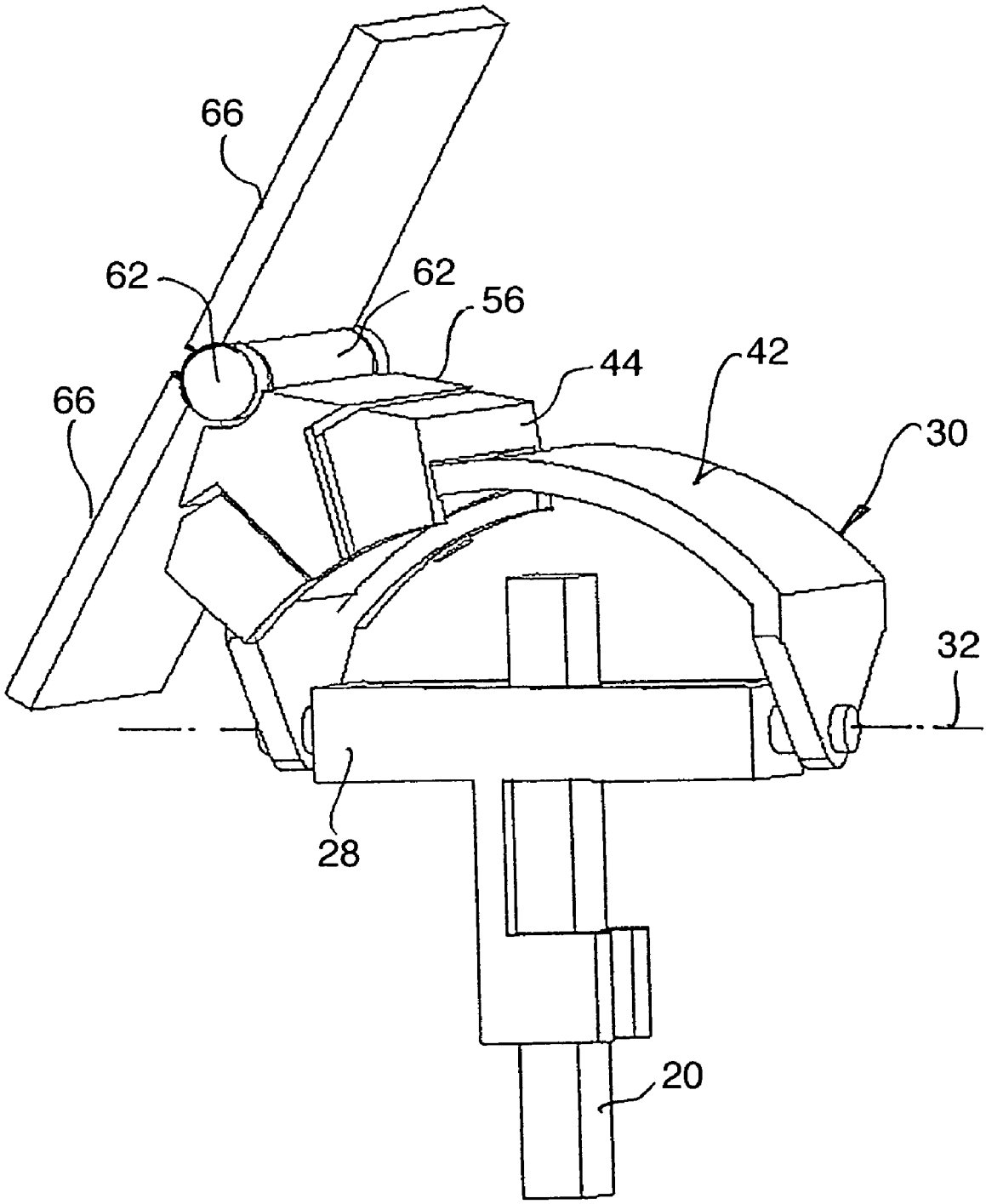

FIG. 12 shows the saddle 44 at the end of the guide track 42, with the bed 12 at the same time being inclined with respect to the connecting frame 56. It can be seen that the angle of inclination of the bed can be made very large, without the bed butting against the column head.

FIG. 13 shows the saddle 44 in the same position as in FIG. 12, although the segments 66 are pivoted about the axis of the shaft 62 in relation to one another. This makes it possible to set the patient bed, without major changes, such that patients can be supported in a suitable way for rectal interventions.

Figure 14:
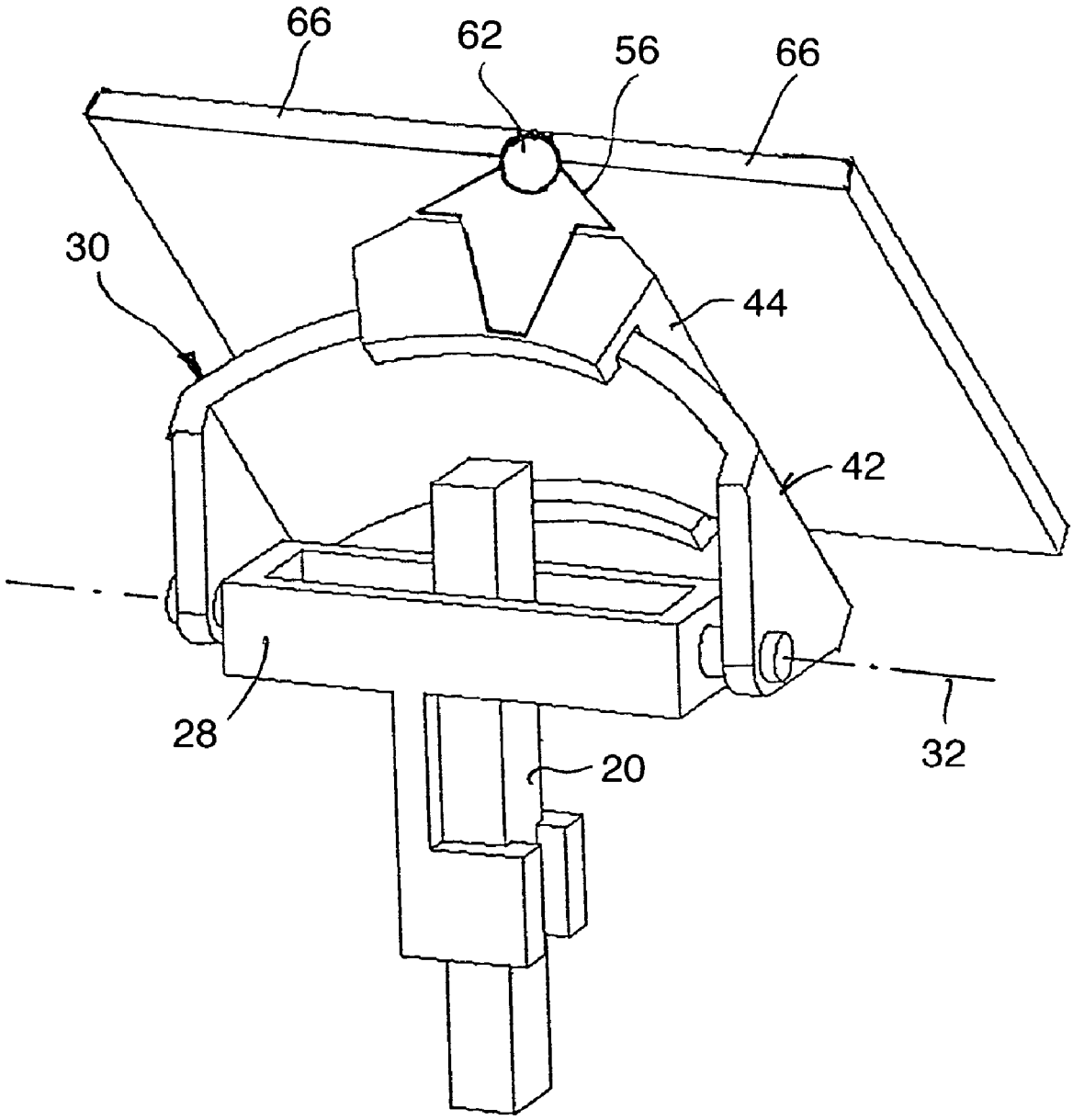
Figure 15:
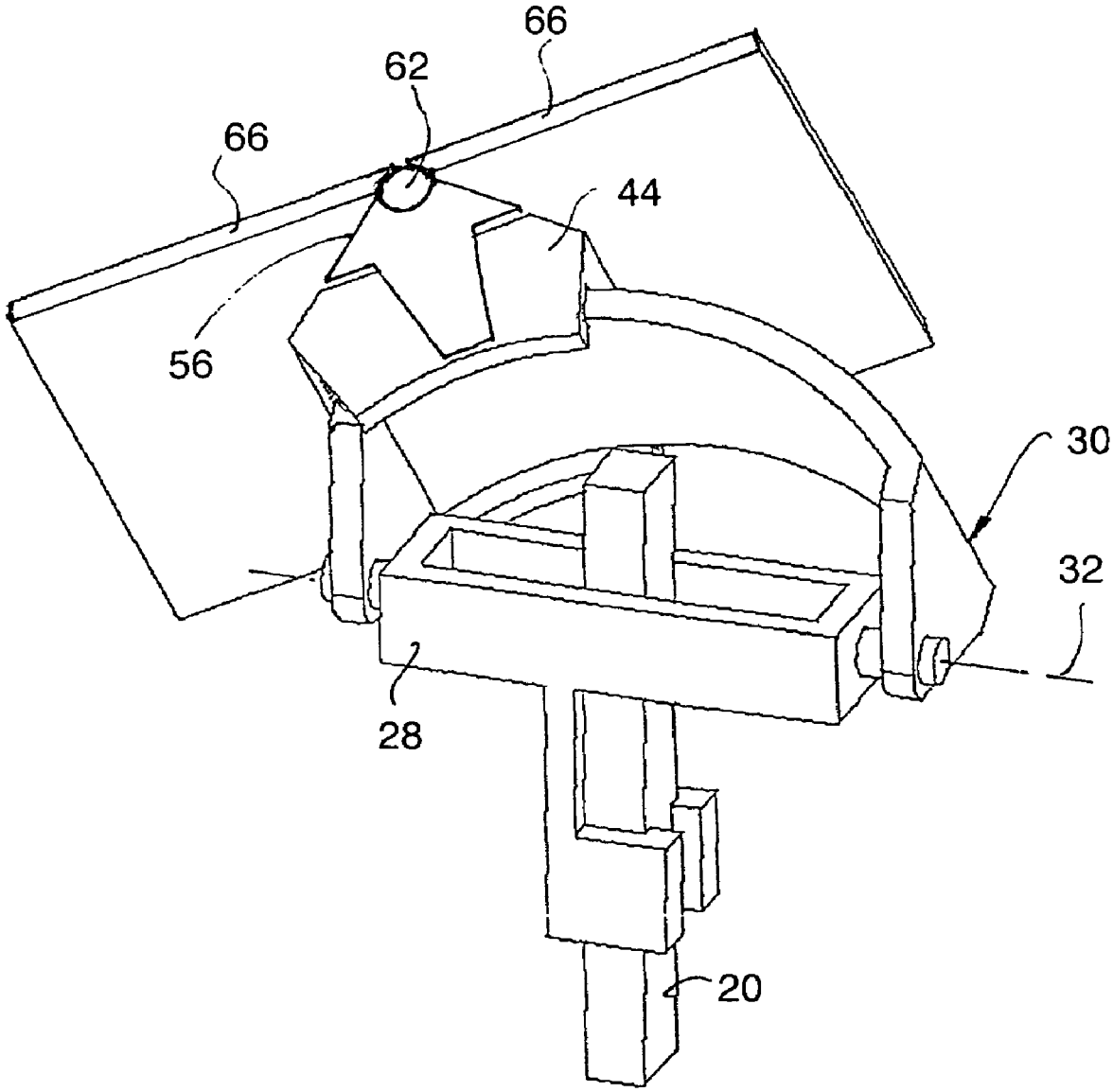

FIG. 14 shows the head frame after a pivoting movement about the axis 32, that is to say about the axis of tilt of the bed 12. In FIG. 15, the tilting movement as a result of a pivoting of the head frame is combined with an inclination movement as a result of the displacement of the saddle on the guide track.

The above statements show that the solution according to the invention considerably broadens the range of adjustment of the bed 12 both in the vertical direction and about the axis of inclination and the axis of tilt. At the same time, the principle of the saddle displaceable on the guide track makes it possible, without further aids, to have a horizontal displacement of the bed 12.

In the exemplary embodiments illustrated, the bed is coupled to the saddle such that the bed longitudinal direction is directed parallel to the direction of displacement of the saddle on the guide track or perpendicularly to the axis of curvature of the guide track. Thus, during the displacement of the saddle on the guide track, the bed 12 executes a movement about the axis of inclination. It is likewise also possible, however, to couple the bed, rotated through 90°, to the saddle, such that, during the displacement of the saddle on the guide track, the bed executes a movement about the axis of tilt, that is to say about an axis running parallel to its longitudinal direction.

While the present invention has been illustrated and described with respect to a particular embodiment thereof, it should be appreciated by those of ordinary skill in the art that various modifications to this invention may be made without departing from the spirit and scope of the present invention.

What is claimed is:

1. An operating table comprising:

a table column with a column foot and with a column head;

and a patient bed which is connectable to the column head and which is pivotable in relation to the table column about at least one axis parallel to the bed plane, wherein the column head has provided on it a guide track which is curved continuously about an axis of curvature and on which a saddle coupleable to the bed is mounted such that it can be adjusted along the guide track by means of a saddle drive, and wherein the guide track is arranged on a head frame which is pivotable with respect to the table column by means of a pivoting drive about a pivot axis perpendicular to the axis of curvature of the guide track.

2. The operating table according to claim 1, wherein the axis of curvature of the guide track lies within the table column.

3. The operating table according to claim 1, wherein the saddle drive comprises at least one saddle-side gear element which can be driven by means of a motor and which is in engagement with a gear element arranged on the head frame.

4. The operating table according to claim 3, wherein the saddle-side gear element is a worm and the gear element fastened to the head frame is a toothed ring.

5. The operating table according to claim 1, wherein the pivoting drive comprises two pressure-medium-actuated pivoting cylinders which are arranged within the column and, on the one hand, are supported on the column head and, on the other hand, engage on the head frame on both sides of the pivot axis.

6. The operating table according to claim 1, wherein the pivoting drive comprises at least one worm wheel connected fixedly in terms of rotation to the head frame and arranged coaxially with respect to the pivot axis and a worm which can be driven by means of a motor and is in engagement with the at least one worm wheel.

7. The operating table according to claim 1, wherein the column head is adjustable with respect to the column foot by means of a height drive.

8. The operating table according to claim 7, wherein the height drive comprises a telescopic vertical guide and a linear drive.

9. The operating table according to claim 1, wherein the bed is arranged on a connecting frame having coupling elements which are intended for engagement with countercoupling elements arranged on the saddle.

10. The operating table according to claim 9, wherein the bed is mounted on the saddle or the connecting frame pivotably about a pivot axis directed transversely to its longitudinal direction.

11. The operating table according to claim 10, wherein the bed is pivotable in relation to the saddle or connecting frame by means of a bed actuating drive.

12. The operating table according to claim 11, wherein the bed actuating drive comprises at least one drive unit with at least one servomotor which is fastened to the connecting frame or to a bed portion connected to the connecting frame and which is in engagement with an element to be driven, connected in each case to the other part (bed portion or connecting frame).

13. The operating table according to claim 12, wherein the bed actuating drive includes a drive unit provided on each side of the connecting frame with respect to the bed pivot axis.

14. The operating table according to claim 11, wherein the bed comprises at least two bed segments which are connected to one another in an articulated manner about a joint axis coaxial with respect to the bed pivot axis, and in that the bed actuating drive is designed such that the at least two bed segments can be adjusted together or individually each separately.

15. The operating table according to claim 11, wherein the bed actuating drive comprises at least one drive unit with at least one servomotor which is fastened to the connecting frame or to a bed portion connected to the connecting frame and which is in engagement with an element to be driven, connected in each case to the other part (bed portion or connecting frame), wherein the bed comprises at least two bed segments which are connected to one another in an articulated manner about a joint axis, and the bed actuating drive is designed such that the at least two bed segments can be adjusted together or individually each separately, and wherein the at least one servomotor of the bed actuating drive is drive connected in each case via a coupling to one of the bed segments.

16. The operating table according to claim 15, wherein the at least one servomotor drives in each case a gearwheel which is in engagement with a toothed ring on the respective bed segment.

17. The operating table according to claim 1, wherein the bed can be coupled to the saddle in such a way that the longitudinal direction of the bed is perpendicular to the axis of curvature of the guide track.

18. The operating table according to claim 1, wherein the bed can be coupled to the saddle in such a way that the longitudinal direction of the bed is directed parallel to the axis of curvature of the guide track.

19. An operating table comprising:

a table column with a column foot and with a column head;

and a patient bed which is connectable to the column head and which is pivotable in relation to the table column about at least one axis parallel to the bed plane, wherein the column head has provided on it a guide track which is curved continuously about an axis of curvature and on which a saddle coupleable to the bed is mounted such that it can be adjusted along the guide track by means of a saddle drive, and wherein the saddle drive has at least one push and/or pull element which is flexible at least in one direction and which is guided displaceably along the guide track and is connected, on the one hand, to the saddle and, on the other hand, to an actuator.

20. The operating table according to claim 19, wherein the actuator is a linear drive.

21. The operating table according to claim 20, wherein the linear drive is a pressure-medium-actuated cylinder.

22. The operating table according to claim 6, wherein the at least one push and/or pull element is connected directly to the piston of the pressure-medium-actuated cylinder.

23. The operating table according to claim 19, wherein the at least one push and/or pull element is a rigid-back chain.

24. The operating table according to claim 19, wherein the saddle drive comprises two push or pull elements which are connected in each case to an actuator and which are arranged and switched such that they operate reciprocally.

25. An operating table comprising:

a table column with a column foot and with a column head; and a patient bed which is connectable to the column head and which is pivotable in relation to the table column about at least one axis parallel to the bed plane, wherein the column head has provided on it a guide track which is curved continuously about an axis of curvature and on which a saddle coupleable to the bed is mounted such that it can be adjusted along the guide track by means of a saddle drive, wherein the bed is arranged on a connecting frame having coupling elements which are intended for engagement with countercoupling elements arranged on the saddle, wherein the bed is mounted on the saddle or the connecting frame pivotably about a pivot axis directed transversely to its longitudinal direction, wherein the bed is pivotable in relation to the saddle or connecting frame by means of a bed actuating drive, wherein the bed actuating drive comprises at least one drive unit with at least one servomotor which is fastened to the connecting frame or to a bed portion connected to the connecting frame and which is in engagement with an element to be driven, connected in each case to the other part (bed portion or connecting frame), and wherein the at least one servomotor is coupled to the gearwheel via a gear worm which is mounted axially displaceably, the gear worm is prestressed into a first axial end position, and the gear worm is assigned a limit switch controlling the energy supply of the at least one servomotor, in such a way that, during the axial displacement of the gear worm, the limit switch is actuated at the second axial end position of the gear worm.

* * * * *